US006959465B1

(12) United States Patent
Foster

(10) Patent No.: US 6,959,465 B1
(45) Date of Patent: Nov. 1, 2005

(54) HAMMER

(76) Inventor: Robert Foster, 775 Youngneck Rd., Mobile, AL (US) 36608

( * ) Notice: Subject to any disclaimer, the term of this patent is extended or adjusted under 35 U.S.C. 154(b) by 0 days.

(21) Appl. No.: 10/291,451

(22) Filed: Nov. 6, 2002

Related U.S. Application Data

(63) Continuation-in-part of application No. 09/733,354, filed on Feb. 6, 2001, now abandoned, and a continuation of application No. 09/313,417, filed on May 17, 1999.

(60) Provisional application No. 60/119,546, filed on Feb. 10, 1999, provisional application No. 60/086,001, filed on May 19, 1998.

(51) Int. Cl.[7] ..... B25D 1/06
(52) U.S. Cl. ..... 7/143; 81/20; 81/24; 81/489
(58) Field of Search ..... 7/143; 81/20, 489, 81/490, 492, 488, 125, 177.1, 177.2, 24

(56) References Cited

U.S. PATENT DOCUMENTS 3,228,720 A * 1/1966 Jordan ..... 294/65.5
3,425,468 A * 2/1969 Soucy ..... 81/489
4,145,939 A * 3/1979 Garrison ..... 81/125
4,291,736 A * 9/1981 Robertson et al. ..... 81/24
4,753,138 A * 6/1988 Soucy ..... 81/24
4,944,203 A * 7/1990 Miller ..... 81/24
5,000,064 A * 3/1991 McMahon ..... 81/24
5,178,048 A * 1/1993 Matechuk ..... 81/125
5,901,622 A * 5/1999 Sweeny ..... 81/439

FOREIGN PATENT DOCUMENTS

JP 2000176858 A * 6/2000 ..... B25D 1/06
JP 2002238624 A * 8/2002 ..... A45B 9/02

* cited by examiner

*Primary Examiner*—David B. Thomas

(57) ABSTRACT

The invention is a magnetized tool for holding or retrieving nails. This is shown as a hammer having a magnet which may be on a removable cover or an extendable arm, mounted within the shaft or adjacent to the shaft of a hammer on the removable cover. The magnet is removable from the shaft to temporarily magnetize the striking face of the hammer so that a nail mail be held on the striking face temporarily. The magnet may be removably held to the hammer with a magnetic metal, such as another magnet which may be similar in size and shape and may be glued in place on the hammer. In another embodiment, the tool is a paint shield which may have bens to fit under walls. The shield may also serve to hold paint absorbing sheets to prevent spills and to clean up spills. The sheets may define a curving lip which curves upward to catch paint spills.

7 Claims, 9 Drawing Sheets

HAMMER

This patent is a continuation of Provisional Patents: 60/119,546 filed Feb. 10th, 1999; 60/086,001 filed May, 19th, 1998 and Utility Patent: 09/313,417 filed May 17th, 1999 and CIP patent 09/733,354 filed Feb. 6, 2001, now abandoned.

BACKGROUND OF INVENTION

1. Field of Invention

This invention pertains to hammers and to magnets. More particularly, the invention pertains to hammers having magnetized part or having magnets attachable to the various parts of the hammer for different purposes. Additionally disclosed is a paint shield which may be magnetized for hanging or for holding nails, metal paint brushes and the like during the painting operation.

2. Prior Art

The prior art of hammers shows many different hammering devices. Also magnetized screwdriver heads are well known. None of the known hammers have included therein a magnet for picking up nails that have fallen in the form taught herein.

Several paint shields are known in the prior art. The improvements in the present invention are its unique storage elements and it design to fit within spaces left between carpets and molding when used and its design to hold paint absorbing sheets of cloth or paper.

GENERAL DISCUSSION OF INVENTION

When utilizing this invention or any other hammer nails are often dropped and typically the user may be in an elevated position and may have to either reach down to get the nail or even climb down from elevated heights. Also, although not as dangerous, users of nails have to reach into pouches, buckets or bags of nails. Retrieving nails is not difficult, but can be irritating. Typically, the magnetization features of tools can be an incumbrance in the event that the magnet cannot be removed from the tool or can interfere with the tool when used. Also, prior art magnetization is often a matter which must occur before the tool is delivered.

It is therefore an object of this invention to provide a hammer which contains magnets at strategic locations for acquisition of metallic objects.

The same improvement is found on a paint shield.

It is an additional object of the invention to provide a hammer which has a magnet installed in the handle for retrieving nails.

It is an additional object of the invention to provide a hammer which has a magnet installed in the head for holding nails when starting nails.

It is an additional object of the invention to provide a hammer which has a magnet removably installed in or on the handle or head of a hammer.

It is a further object of the disclosure to provide a paint shield which can be used to protect surfaces under molding between the molding and the carpet or floor of a house.

It is a further object to provide a shield which holds paint absorbing sheets to minimize or clean up splits.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
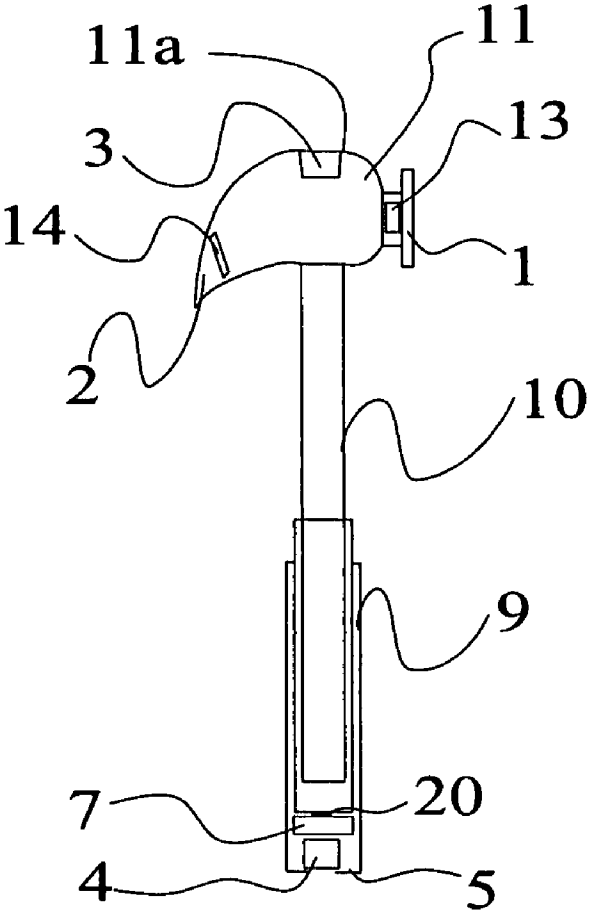
FIG. 1 shows a side view of the hammer disclosed showing locations where magnets can be present.
Figure 12:
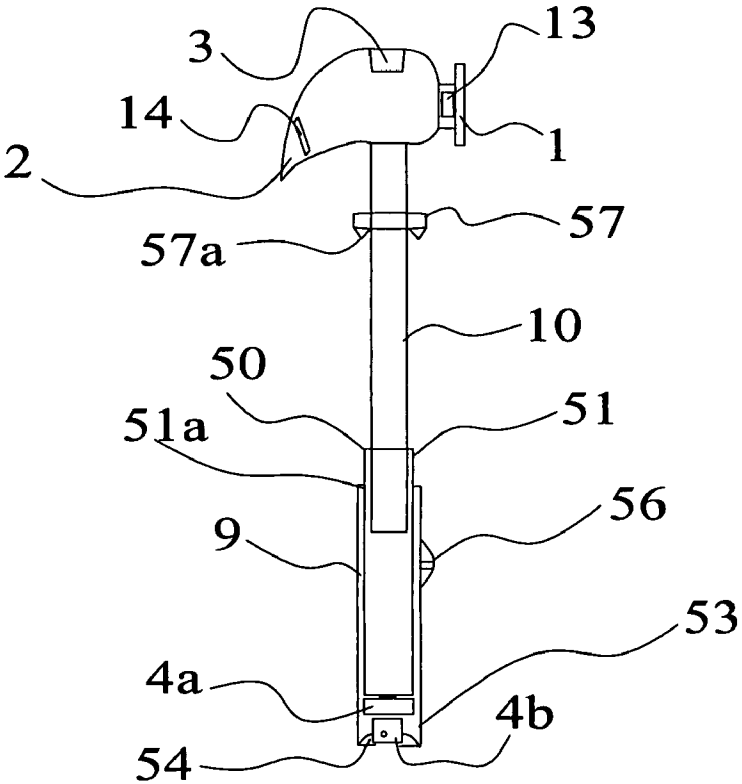
FIG. 12 shows the cover of FIG. 11 partially removed.
Figure 11:
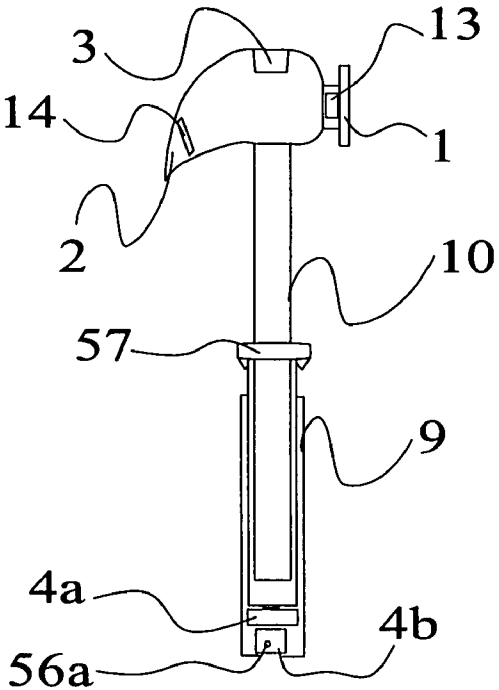
FIG. 11 shows a modified cover.
Figure 13:
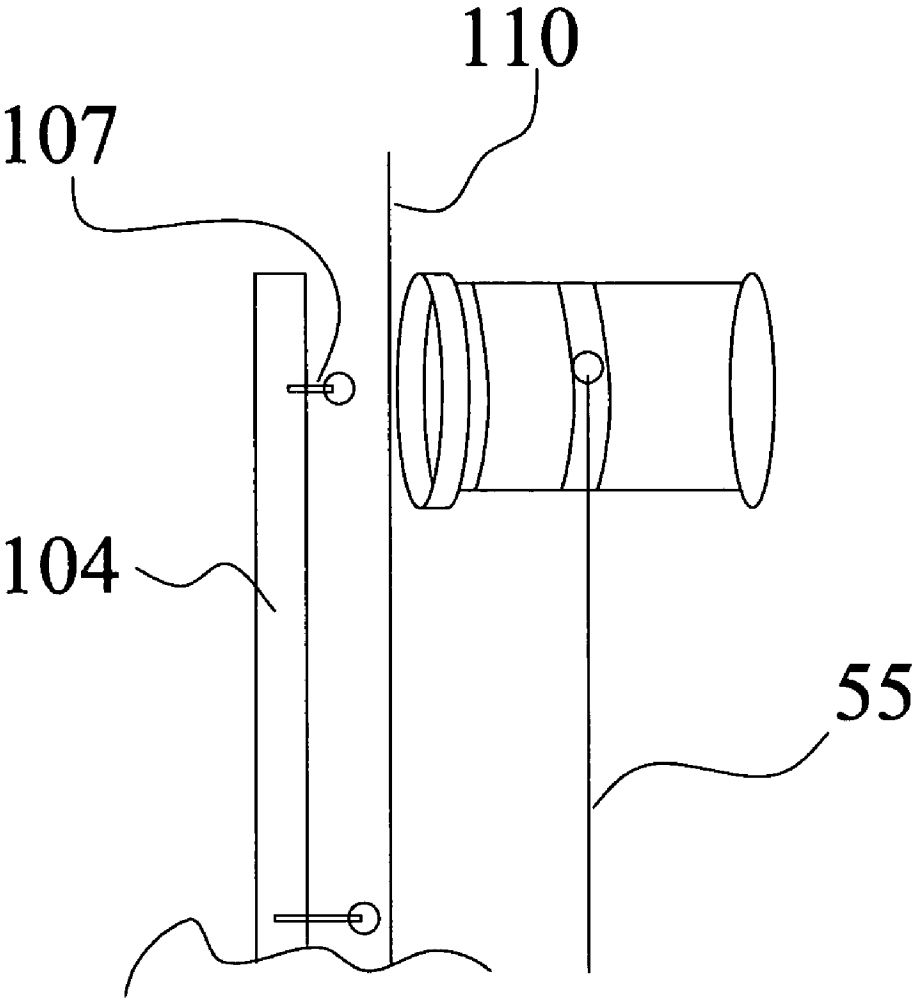
FIG. 13 shows the removed cover from FIG. 11.

As can best be seen reference to FIG. 1, the simplest embodiment the invention comprises a hammer head 11 having a striking head 1 and a claw 2. At the top of this hammer head 11 is a top magnet 3 would be in place which could serve at least two purposes. One purpose would be to allow for dropped nails and other metal particles to be picked up and another purpose could be to actually magnetize the head 11 of the claw. It could also be used in order to secure the hammer to a metal tool holder. A shaft 10 extends downward from the hammer head 11 and often times will actually fit through the top 11*a* of the hammer head 11 so that the top magnet 3 may actually be embedded into the top of the shaft 10 where the shaft 10 fits into the hammer head 11 and possibly through the hammer head 11. Typically in a metal hammer shaft 10 there will be a rubber handle cover 9. This rubber handle cover 9 need not be a part of a wooden hammer. FIGS. 12 and 11 and 13 show how the cover 9 may be removed and used. As shown in FIG. 1, the head 11 may be magnetized at the front 13 and rear 14.

The present invention envisions having a bottom magnet 4 which is attached to the bottom of the shaft 10 and usually at least partially surrounded by the bottom part 5 of the rubber handle 9. To use the device to pick up a nail, the magnet at the top 3 or bottom 4 is extended by the user and the magnet pick up nails 16.

Figure 2:
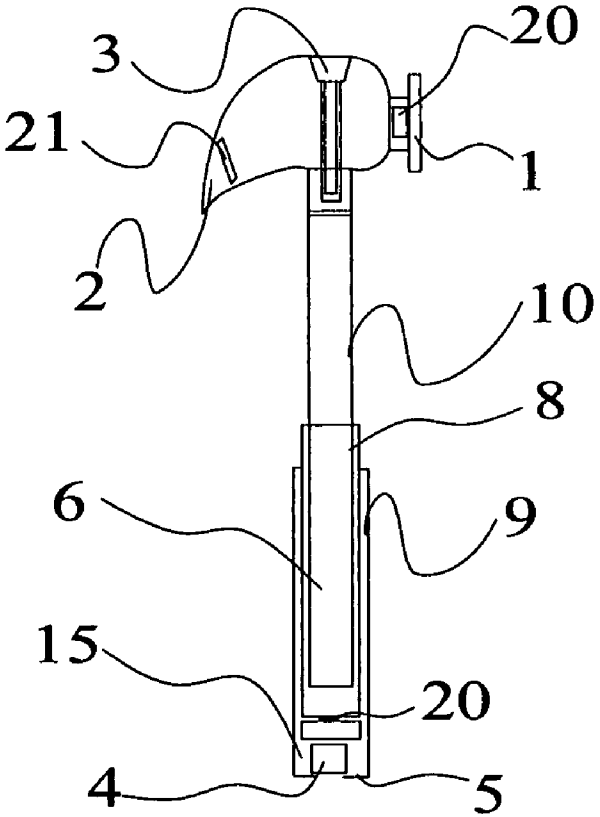
FIG. 2 shows a side view of an alternate embodiment with an extendable arm in the handle and in the head of the hammer.
Figure 4:
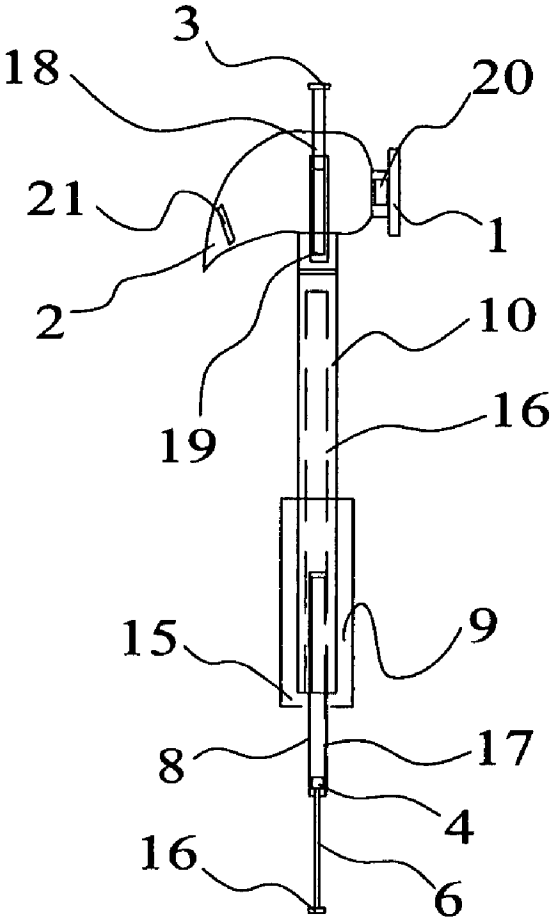
FIG. 4 shows the embodiment of FIG. 2 when the extendable arms are extended.

In FIGS. 2 and 4, it can be seen that a telescoping bottom arm 12 which has a top leg 8, extending into the shaft 10. There is a bottom leg 6 which extends into the top leg 8 so that the magnet 4 at the end of the bottom leg 6 may all be folded within or retracted within the shaft 10 or the bottom of the rubber handle 9. When retracted, the bottom magnet 4 may be encased in a rubber magnet casing 5. This casing 5 may be a continuous part of cover 9. In addition the bottom magnet 4 may fit within a space 15 or may actually be embedded within the shaft 10.

FIG. 2 shows how front magnet 20 and rear magnet 21 can be placed on the striking head and claw, respectively, to magnetize these areas.

As shown in FIG. 4, the extension of the top leg 8 fits within the shaft 10 and the bottom leg 6 fits within the top leg 8.

As shown in FIG. 4, the magnet 4 may be on the top of the bottom leg 6 as long as the legs 6 and 8 are ferrous and the magnet 4 is capable of exerting a magnetic force of sufficient strength on the extended bottom leg 6. FIG. 4 shows the legs 6 and 8 extended as well as the top magnet 3 extended on a top arm 18 extending from a top chamber 19 in the striking head 1. This give a long distance between the top most point at the top magnet 3 and the bottom magnet 4.

Figure 5:
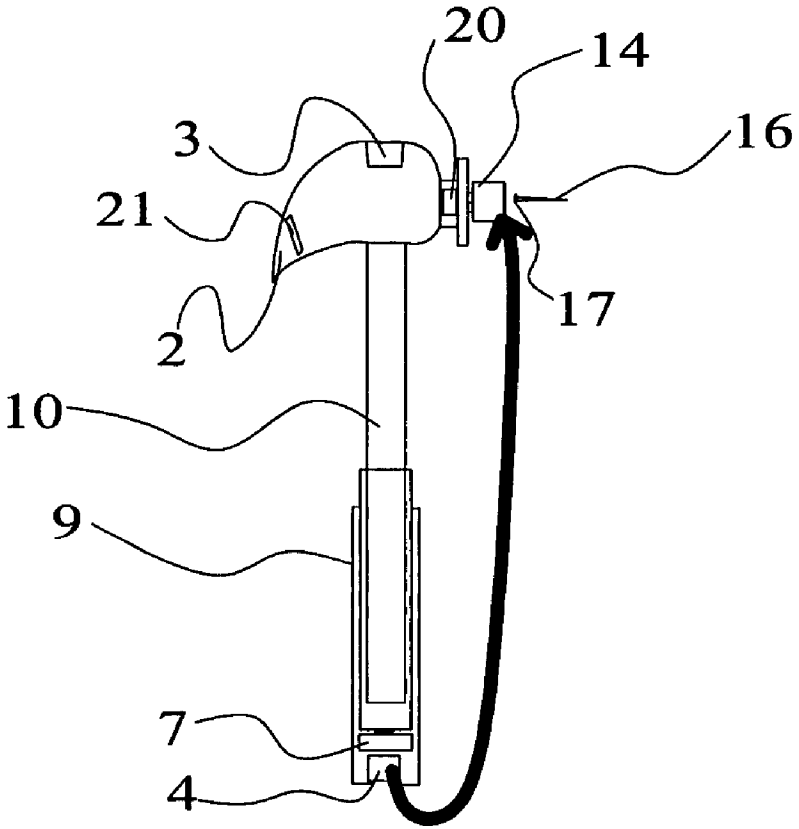
FIG. 5 shows an alternative embodiment where a notch is present for removing a removable magnet to be placed on the head of the hammer as shown.

FIG. 5 shows how a removable magnet 4 may be moved from where it is attached to the shaft 10 to the striking head 1 to hold a nail 16 by the nail base 17. In this way, the nail can be started and then the magnet replaced on the shaft. This is also accomplished with permanent or insertable front magnets 20 shown in FIG. 2.

Figure 6:
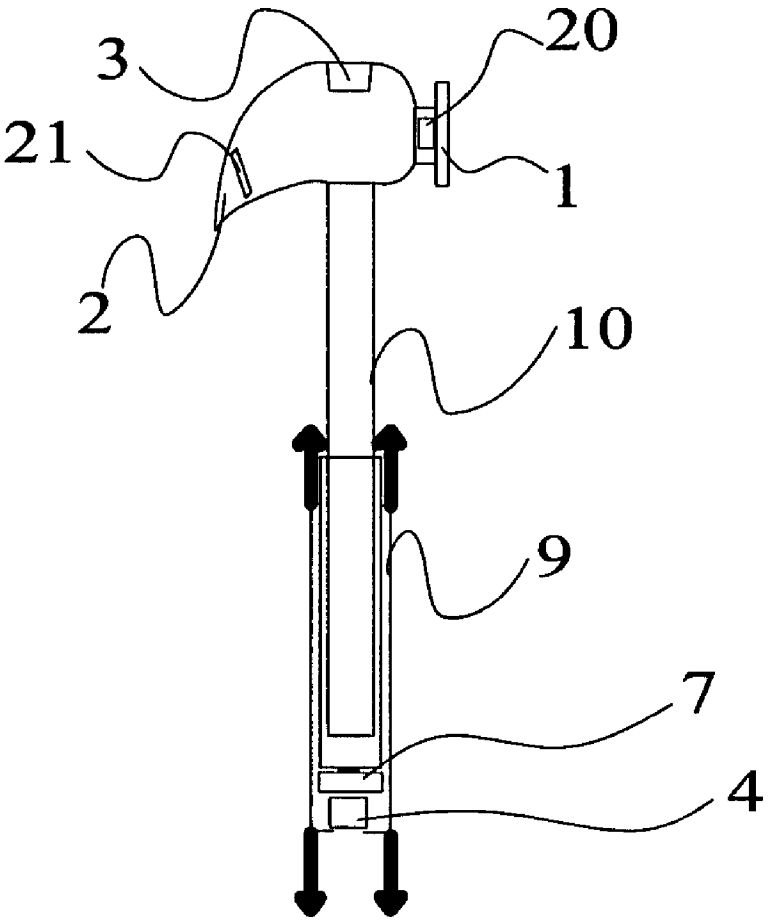
FIG. 6 shows an alternate embodiment where the cushion of the handle may be moved to access the removable magnet or to expose a permanent magnet.

FIG. 6 shows how the rubber handle cover 9 may slide along the shaft 10 to expose or cover the bottom magnet 4.

Figure 7:
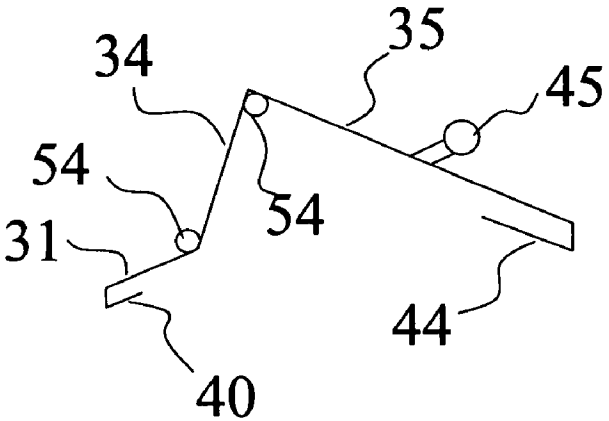
FIG. 7 shows a side view of the paint shield disclosed.

As can be seen by the FIG. 7, the shield consists of a small edge 31 which fits underneath a length of molding 32 on a wall 29 between the molding 32 bottom and the surface (here carpet) 33. The invention is preferably made of a single sheet of bent sheet metal. After the small edge 31 comes from under the molding 32, it angles upward with a paint catching plate 34 and then angles back down out of the way in an extended catch plate 35 which gives even more protection. This single sheet of metal may be bent under the small edge 31 with a front bend 40 and at the rear of the extended catch section at a rear bend 41. These provide smooth curves at the end of the extended catch plate 35 and the small edge plate 31 to allow the device to be slid. The intersection of plates 31 and 34 may also be curved on either end to provide a similar result.

Figure 8:
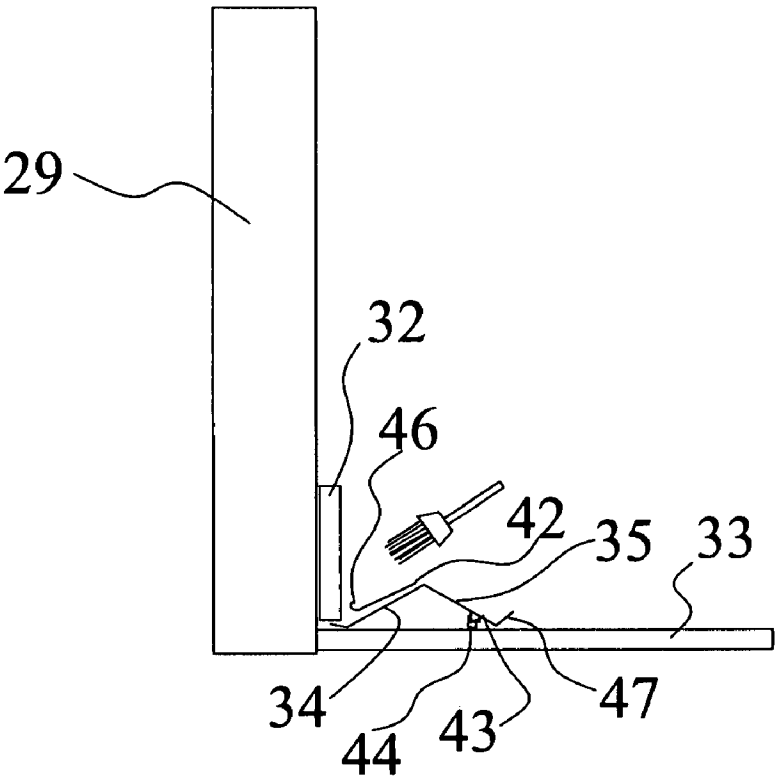
FIG. 8 shows the paint shield of FIG. 7 when in use.

As shown in FIG. 8, the rear bend 41 may be replaced with a bearing or wheel 44 attached to a pivot 43 which is mounted to the underside of the extended catch plate 35.

In the present invention in the preferred embodiment there is angle between 90 degrees and 270 degrees but preferably between 90 degrees and 180 degrees between the top surface of the small edge plate 31 and the top surface of the second plate 34.

In the preferred embodiment this small edge plate 31 is approximately a one quarter (1/4) inch long from the tip to the point where it connects to the second plate 34. The plate catching surface is three quarters (3/4) of an inch long and then meets at an angle between 250 degrees to 320 degrees with the extended catch plate 35. In order to strengthen the invention at the end of a four (4) inch plate catching surface 35 is a bent back reinforcement section 36 which may also include a raised section 37. The invention may also have a knob 45 in place on the extended catch section 35 which will allow the device to be more easily moved back and forth.

A raised back plate 47 may also be present on the extended catch plate and this raised paint plate 47 may be paint absorbing and removable. It may and form a well to collect paint. These may be raised absorbing areas or may be made of paint absorbing material (such as cloth, paper, etc.) non-absorbent material or may be recessed areas which serve to collect paint or utilize the surface tension of the paint to reduce spillage.

Figure 10:
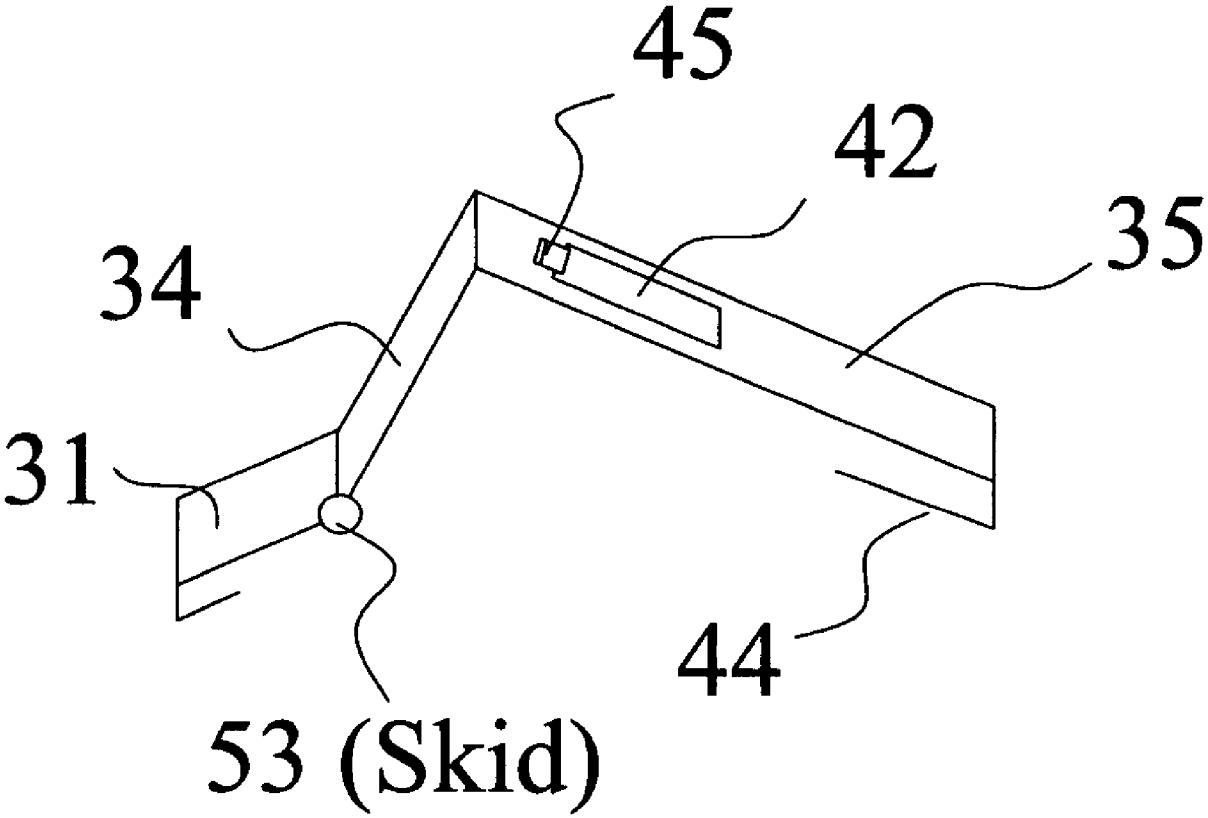
FIG. 10 shows an alternate anti friction device which may be included on the paint shield to allow it to more easily slide.

In addition to the other features disclosed herein both the face of second plate 34 and the face of center plate 35 may be provided with a tear away sheet or other removable sheet 42 such as a sheet of paper with a non-permanent sticking surface or cloth in order to facilitate cleaning. These sheets 42 may be thicker or less thick depending on the amount of paint which collect thereon. The sheets 42 may also be washable so that they do not need to be replaced after use. In addition, several sheets 42 may be present which can tear away in layers so that a sheet 42 may be removed when it is over-used or torn away to clean up a spill which forms during the painting process. These sheets 42 may be attached by a clip 45 as shown in FIG. 10 so that they may be changed or replaced.

In this way after a painting job this removable sheet 42 may be peeled away leaving the underlying plates relatively clean.

This removable sheet 42 may also completely wrap the shield in order to accomplish the same purpose.

Figure 9:
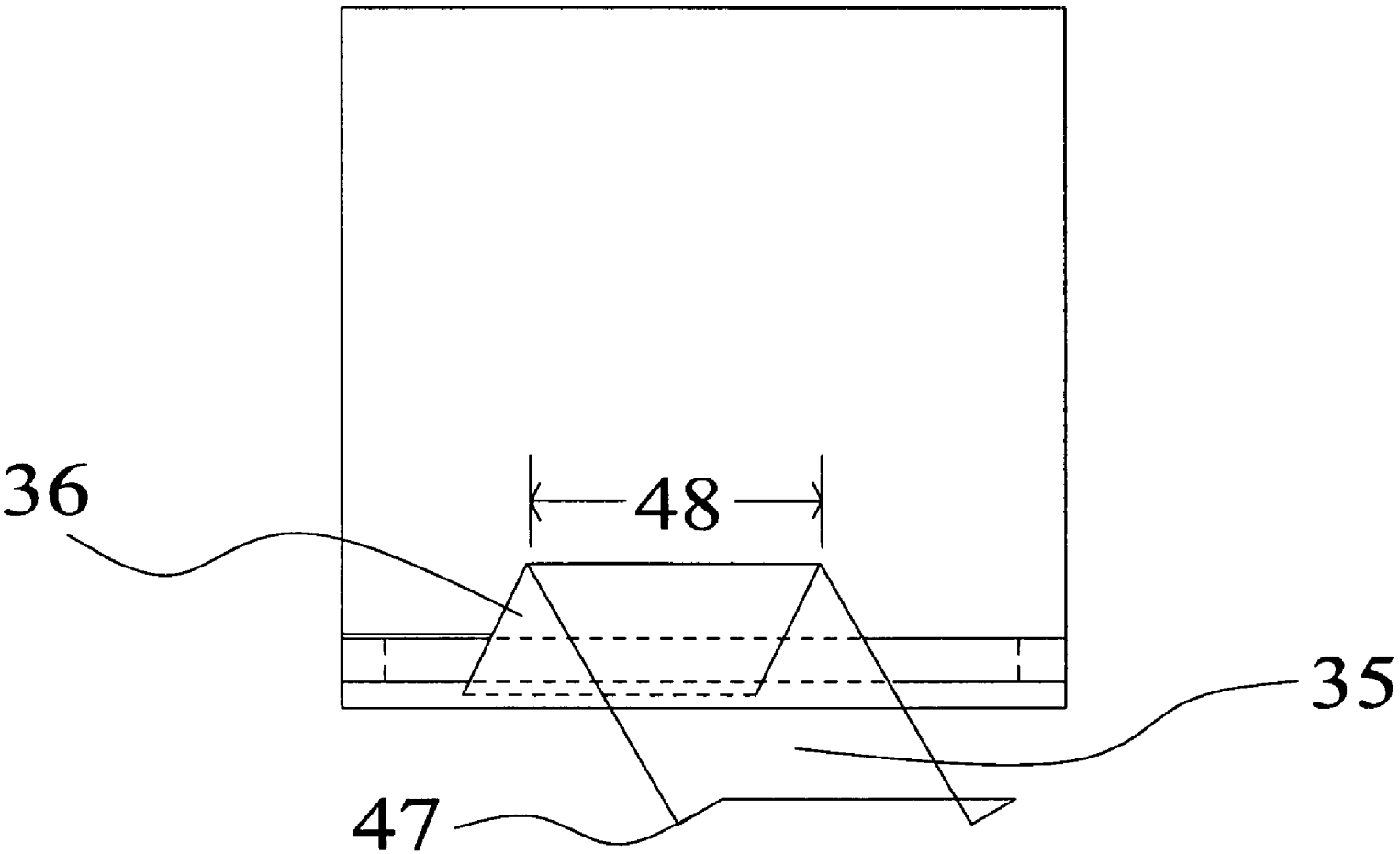
FIG. 9 shows a plan view of the paint shield shown in FIG. 7.

The length 48, shown in FIG. 9 may be as small as 6 inches or as long as 5 feet or even longer for certain jobs. It is preferably six (6) inches to four (4) feet so that it may be easily inserted in place and so that it provides a sufficient area of protection.

The two bases 50, 51 allow for it slide and for reinforcing.

Round skids 53 may be provided on either side of the intersection of the point of intersection between the small edge plate 31 and the second plate 34 to ease movement of the device in either direction as it is slid along the surface 33. The small edge plate 31 may be coated with TEFLON or other non-stick surfaces in order to allow it to slide easily under the molding.

A magnet 54 may be installed between plates 35 and 47 or between plates 34 and 35 or between 31 and 34 so that metallic object by be held in the crevices formed thereby. In this way, nails or screws used in the painting or sheet rocking mud operation may be held for later use or picked up when dropped. Similarly, the tool may be hung by this magnetized portion.

As shown in FIG. 1, a wooden shaft may have a metallic surface 7 held by glue 20 to the bottom of the shaft 10.

The rubber handle cover 9 may be a sock of flexible material which fits over the handle 10 of the hammer. This is preferably a foam or rubber composite so as to elastically expand over the hammer handle 10 and provide cushioning along with a firm hold on the handle 10.

The cover 9 includes a cover body 50 which is preferably made in part at least, of flexible material so that it clings to the hammer's shaft 10. The body 50 may be of sufficient length to extend over the gripped portion of the handle in order to provide additional cushioning for the user. The body 50 may be thick enough in order to provide cushioning.

The cover 9 is preferably sufficiently flexible so that it will cling to the hammer but be removable. It may have a ring 51 at the top of clinging material. The body may also be short enough so that it does interfere with the grip of the user but otherwise serves the same purpose.

As show in FIG. 12, the cover 9 slides over he existing hammer handle 9. At the top of the body is an opening 52 which receives the handle 9 of the hammer. Opposite this opening 52 is the bottom of the cover 9 which holds the magnetic metal or magnetizable metal 4*a*. If the metal 4*a* is magnetized, the product need not have an additional magnet, but in the preferred embodiment there is a second bottom magnet 4*b* which is removable or attachable to the metal 4*a* by virtue of the magnetic attraction.

The body may have an extension 53 which fits over either the metal 4*a* or the bottom magnet 4*b* or both to prevent them from being inadvertently removed. If the tolerances between the sock extension 53 and circumference of the bottom magnet 4*b* are frictionally sufficiently tight, the metal 4*a* may be absent and the magnet 4*b* may be held by friction.

In this way the device can be used to pick up nails or the magnet 4*b* may be removed so as not to interfere with nails or to be cleaned of metal filings.

Figure 14:
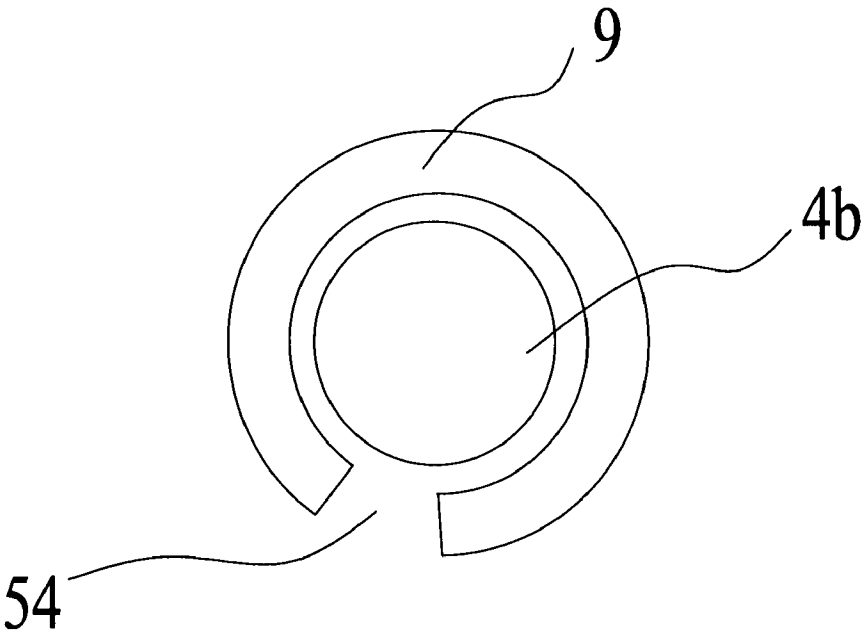
FIG. 14 shows a detailed view of the slot for accessing the magnet.

The extension 53 may be of hard material so that the magnet 4*b* fits which may have a notched opening 54 so that the edge of the magnet 4*b* may be accessed and removed. In this case, the notched opening 54 should be deep enough so the user can get to the point where the magnet 4*b* and metal 4*a* contact one another. FIG. 14 shows a detailed view of the notched opening 54 for accessing the magnet 4*b*.

Figure 15:
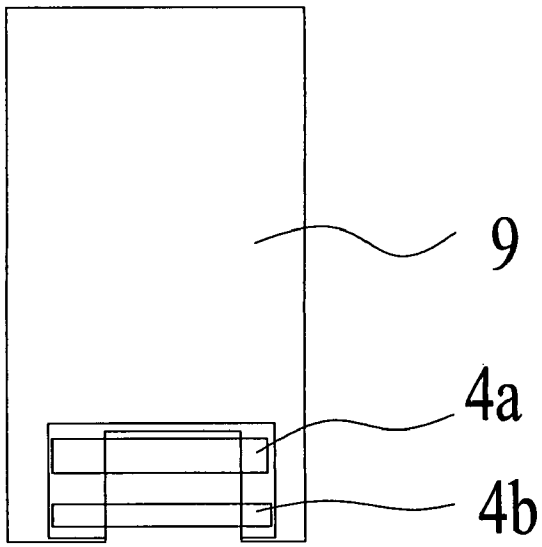
FIG. 15 shows a cross sectional view of the view shown in FIG. 14.

FIG. 15 shows a cross sectional view of the view shown in FIG. 14, showing where a second magnet 4*a* may be accessed. In the preferred embodiment, the walls of the magnet holder 9 would be tight enough to frictionally hold the magnets 4*a* and 4*b* in place.

The body 9 is removable and its weight is less than the strength of the magnet 5 to hold the body 9 to a metallic object, in the preferred embodiment. It may serve to locate nails 107 within a wall 110 by moving the cover 9 along the wall with the magnet 4*a* or 4*b* in contact with the wall 110 until it is aligned with a nail at which point it will stick to the wall 110.

A string 55 may be attachable to the body 9 by way of an edge 56 formed in the body 9. As shown in FIG. 11, there may be an eye 56*a* which is in the magnet 4*b* so that only the magnet is used as a nail locator. The string 55 hangs down tracing the approximate location of the stud 104 from the point where the cover 9 sticks to the wall opposite the embedded nail 107 so that a lower location of the stud 104 may be approximately determined to the extent that the wall is square.

A gripping means 57 may be used which in the embodiment shown in FIGS. 11 and 12 has flexible arms with clips 57*a* which secure into notches 51*a* defined in the gripping area 51.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A handle cover for a hammer having a handle bottom having a handle with a gripping portion and a hammer head comprising:

a) a body having a top and a bottom and a first length between the top and the bottom and a second length having an inner wall extending from the handle bottom to the body bottom and a body circumference wherein the top is open and the length is hollow attached over the handle;

b) a magnet having a length and a circumference attachable to the cover bottom;

c) a chamber defined the handle bottom and the body bottom and the second length inner wall and wherein the second length is approximately equal to the length of the magnet; and d) a magnetic means adjacent to the handle bottom for releasably holding the magnet and wherein the cover defines an opening along the cover circumference to the magnet circumference.

2. The handle cover of claim 1:

wherein the body has an outer surface and wherein the outer surface defines an opening for receiving a length of string and wherein the weight of the cover is less than the gripping strength of the magnet.

3. The handle cover of claim 2 further comprising:

a) a body having a top and a bottom and a length between the top and the bottom and wherein the top is open and the length is hollow so that the body is attachable over the handle;

b) a magnet having a length and a circumference attachable to the cover bottom;

c) an attachment means for releasably holding the magnet to the cover bottom and wherein the magnet defines an opening along it's circumference for receiving a string.

4. The handle cover of claim 3 wherein the cover is comprised of elastic material.

5. The handle cover of claim 1 wherein the second length is made of rigid non-elastic material.

6. A handle cover for a hammer having a handle with a gripping portion and a hammer head comprising:

a) a body having a top and a bottom and a length between the top and the bottom and wherein the top is open and the length is hollow so that the body is attachable over the handle;

b) a magnet having a length and a circumference attachable to the cover bottom;

c) an attachment means for releasably holding the magnet to the cover bottom and wherein the length of the cover is between 3 and 12 inches.

7. The handle cover of claim 6 wherein the cover further comprises a gripping means permanently attachable to the hammer for releasably holding the handle cover in place on the handle to prevent slippage.

* * * * *